US010060693B2

(12) United States Patent
Bubits

(10) Patent No.: US 10,060,693 B2
(45) Date of Patent: Aug. 28, 2018

(54) GUN WITH SAFETY TRIGGER

(71) Applicant: BUBITS GMBH, Oberpullendorf (AT)

(72) Inventor: Wilhelm Bubits, Lutzmannsburg (AT)

(73) Assignee: BUBITS GMBH, Oberpullendorf (AT)

( * ) Notice: Subject to any disclaimer, the term of this patent is extended or adjusted under 35 U.S.C. 154(b) by 0 days.

(21) Appl. No.: 15/484,548

(22) Filed: Apr. 11, 2017

(65) Prior Publication Data

US 2017/0299305 A1 Oct. 19, 2017

(30) Foreign Application Priority Data

Apr. 15, 2016 (AT) ..... GM90/2016

(51) Int. Cl.
*F41A 17/46* (2006.01)
*F41C 3/00* (2006.01)

(52) U.S. Cl.
CPC ..... *F41A 17/46* (2013.01); *F41C 3/00* (2013.01)

(58) Field of Classification Search
CPC ..... F41A 17/46; F41A 17/00; F41A 17/54; F41C 3/00
USPC .... 42/66, 70.01, 70.07, 70.09, 70.06, 70.08, 42/69.01, 69.02
See application file for complete search history.

(56) References Cited

U.S. PATENT DOCUMENTS 1,395,141 A 10/1921 Reising
4,691,461 A 9/1987 Behlert
5,402,593 A 4/1995 Lenkarski et al.
6,223,460 B1 5/2001 Schmitter et al.
6,499,243 B1 * 12/2002 Herzog ..... F41A 17/066 42/70.06
6,843,013 B2 * 1/2005 Cutini ..... F41A 17/46 42/70.01
7,373,752 B2 5/2008 Bubits
7,500,327 B2 3/2009 Bubits
D597,626 S * 8/2009 Krieger ..... D22/108
7,690,144 B2 * 4/2010 Fagundes de Campos ..... F41A 17/72 42/69.02
7,810,268 B1 * 10/2010 McGarry ..... F41A 11/00 42/69.01
8,250,799 B2 * 8/2012 Duperry ..... F41A 19/16 42/42.02
9,222,745 B2 * 12/2015 Kallio ..... F41A 17/72
9,291,416 B2 * 3/2016 Wurkner ..... F41A 17/02
9,726,449 B2 * 8/2017 Spinner ..... F41A 17/64
2003/0213159 A1 11/2003 Cutini et al.

FOREIGN PATENT DOCUMENTS

DE 485710 11/1929

OTHER PUBLICATIONS

Austrian Search Report from Austrian Utility Model Application No. GM 90/2016, dated Oct. 24, 2016.

* cited by examiner

*Primary Examiner* — John Cooper
(74) *Attorney, Agent, or Firm* — Greer, Burns & Crain, Ltd.

(57) ABSTRACT

A pistol with a safety trigger, including a trigger lever supported in a housing and arranged in a trigger region, and of a safety lever pivotally mounted therein, wherein the safety lever engages a catch in the housing for ergonomics and reliability reasons, the safety lever is arranged in front of the trigger lever, extends over the clear height of the trigger region and is supported on the trigger lever in such a way that it forms a two-armed lever.

5 Claims, 3 Drawing Sheets

GUN WITH SAFETY TRIGGER

BACKGROUND

The innovation relates to pistols with a safety trigger essentially comprising a trigger lever supported or located in a housing and arranged in a trigger region formed between the housing and a trigger guard, and a safety lever which is pivotally mounted in the trigger lever, the safety lever interacting with a catch in the housing.

Such safety triggers are primarily intended to enable rapid firing. The pistol is secured without touching the trigger. Often, such safety devices interact with the firing pin and drop safety device via the trigger rod.

A safety trigger, which is already known from the DE patent 485 710 from Sauer & Sohn and still present in more recent pistols, comprises a safety lever which is arranged behind the trigger lever and comprises a small projection oriented in the firing direction and projecting through a recess in the trigger lever and preventing a movement of the trigger lever in the blocking position. For release, it must first be pressed by the shooter's trigger finger. In the event of rapid grasping of the pistol or in the case of bad positioning or unfavorable shape of the trigger lever, the small projection is not sufficiently actuated and no shot can be fired. In addition, the projection causes painful pressure points on the trigger finger during repeated firing, due to its small area. Also, when wearing tactical gloves or winter gloves, often the safety lever cannot be moved sufficiently, thus keeping the safety active and rendering firing impossible.

In an improved construction, U.S. Pat. No. 5,402,593, the safety lever forms an extension of the trigger lever. In this case, a joint is arranged between the trigger lever shortened by half of its height and the safety lever adjoining it downwards. The mutually facing ends of the two trigger elements form a positioning stop in the blocking position, however, in the firing position they form a gap, in which the trigger finger may possibly get stuck, when the trigger is released (trigger reset) and the complete forward movement of the trigger can be prevented. This has happened frequently in the case of using gloves.

It is the object of the innovation to avoid all disadvantages of the previously known safety triggers, in particular the disadvantages of the U.S. Pat. No. 5,402,593. The safety trigger should be safe, easy to operate, ergonomically optimal and absolutely reliable.

SUMMARY

According to the invention, this is achieved in that the safety lever is arranged in front of the trigger lever, extends over the entire clear height of the trigger region and is supported in the trigger lever in such a way that it forms a two-armed lever. This causes the trigger finger to immediately locate the safety lever, with or without the use of gloves, to reliably actuate it and to be not tucked in upon release of the trigger lever—trigger reset. Thanks to the two-armed lever, the safety lever cannot be actuated by the inertia of its mass. In an advantageous embodiment, the two arms of the safety lever form a first upper contact surface and a first lower contact surface on their rear side facing the trigger lever, and the trigger lever has an associated second upper contact surface and a second lower contact surface. In the blocking position, the upper contact surfaces abut on each other and, in the release position, the lower contact surfaces abut on each other. Thus, the two relative end positions of the safety lever are clearly defined by the large distance from the pivot axle.

In a further developed embodiment, the safety lever forms a rearward extension which passes through a longitudinal slot of the trigger lever and which also has a cross hole for the pivot axle. The pivot axle is located on both sides of the extension in the trigger lever and accommodates the middle part of a leg spring. The multiple function of the pivot axle simplifies construction and assembly. At the rear end of the extension, a shoulder is formed for blocking engagement in a latch in the housing.

One advantageous detail is that the leg spring is supported with one leg on the upper edge of the slot and with the other leg on the upper edge of the extension. Thus, the safety lever is held in the locked position with a defined force and the extension is held in the latch in the housing.

Alternatively, or additionally to the contact surfaces on the rear side of the safety lever, the lower edge of the extension may be shaped in such a way that, in the blocking position, it rests on the lower edge of the slot.

Finally, the front side of the safety lever, on which the trigger finger engages, can be ergonomically optimized. It is concavely curved over its entire height in side view and is convex in the cross-section. The entire height may also be rectilinear or shaped as desired by the shooter. The innovation according to the invention leaves sufficient scope.

BRIEF DESCRIPTION OF THE DRAWINGS

The innovation will be described and illustrated in the following by means of Figures of an exemplary embodiment, in which.

DETAILED DESCRIPTION

Figure 1:
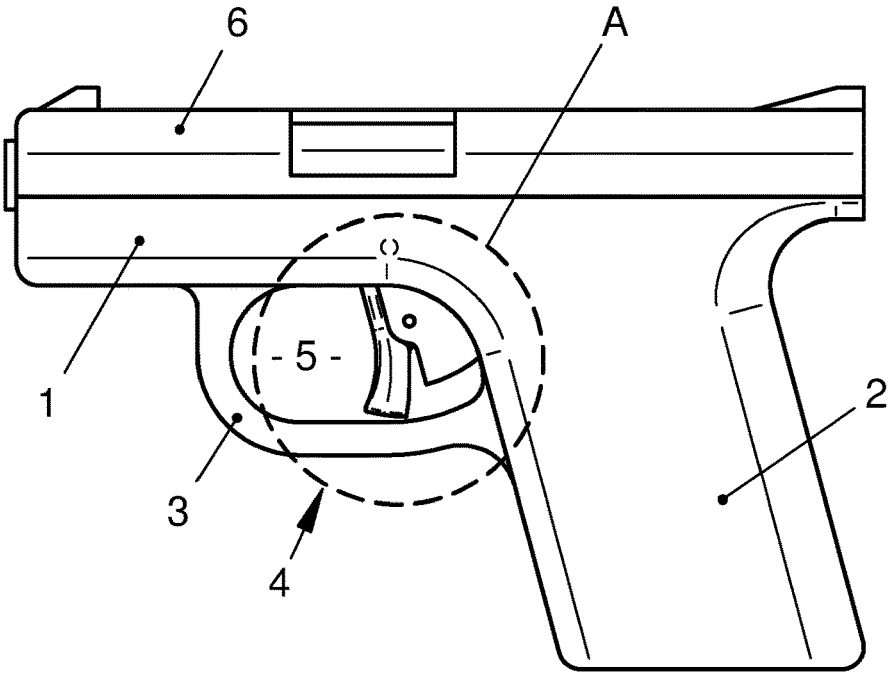
FIG. 1 shows a side view.
Figure 2:
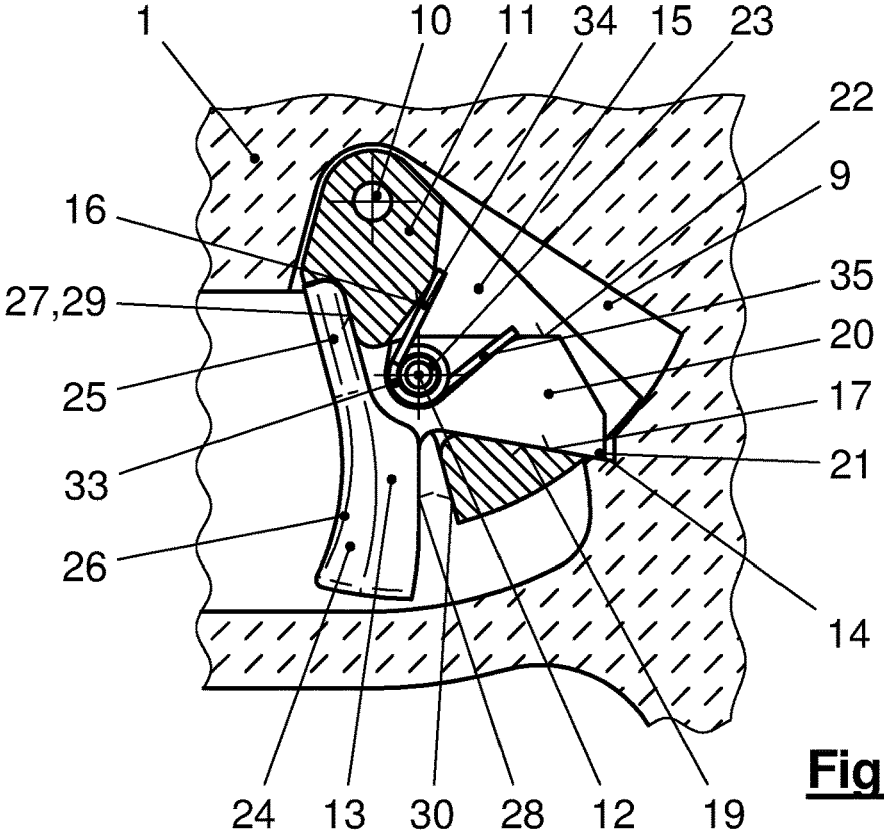
FIG. 2 shows detail A of FIG. 1, in cross-section and enlarged.

In FIG. 1 the housing of a pistol is designated with 1, the handle piece with 2 and the trigger guard with 3. A slide 6 is guided on the housing 1. The housing 1 and trigger guard 3 surround a trigger region 5, in which there is a safety trigger, which is referred to as 4, and which accommodates a finger, not shown, of the shooter. Parts located in the interior of the housing 1 and of the slide 6 are not shown, because they are irrelevant or arbitrary for the innovation. FIG. 2 shows the safety trigger 4 which is accommodated partially in a trigger space 9 inside the housing 1 and projects into the trigger region 5. A trigger lever 11 is pivotally mounted near its upper end about a first axle 10 in the housing 1. A safety lever 13 is arranged so as to be pivotable about a second axle 12 in the trigger lever 11 in front of the trigger lever 11. The trigger lever 11 comprises a continuous longitudinal slot 15 with an upper edge 16 and a lower edge 17, and a cross bore 18 (FIG. 6) for receiving the second axle 12. The trigger lever 11 is connected to a trigger mechanism in any common or given manner, for example by means of a trigger rod, which is not shown.

The safety lever 13 consists of a finger rest 24 and a rearwardly projecting extension 20 which passes through the longitudinal slot 15 in the trigger lever 11 and forms at its rear end a shoulder 21 for engagement in a catch 14 in the trigger region 9. In the secured position, the extension 20 abuts on the lower edge of the longitudinal slot 15 with its lower edge 19 and thus blocks the trigger lever 11.

An eye 23 with a bore 18 for receiving the second axle 12 is formed approximately in the middle of the safety lever 13, near the transition from the finger rest 24 to the extension 20. The eye 23 is surrounded by the middle part of a leg spring 33. Its upper leg 34 abuts on the upper edge 16 of the longitudinal slot 15, its lower leg 35 abuts on an upper edge 22 of the extension 20.

The finger rest 24 of the safety lever 13 forms a two-armed lever with the two lever arms 25, 26, with respect to the second axle 12. The upper lever arm 25 extends upwards up to the housing 1 and has an upper first contact surface 27 on its rear side. Here, the lower lever arm 26 is somewhat longer and stronger than the upper lever arm 25. It forms a lower first contact surface 28 on its rear side. Corresponding second contact surfaces 29, 30 are formed on the trigger lever 11. Here, the lower contact surface 30 does not abut, neither in FIG. 3. The upper contact surface 29 abuts here, in the position of FIG. 5, it is the other way round.

Figure 3:
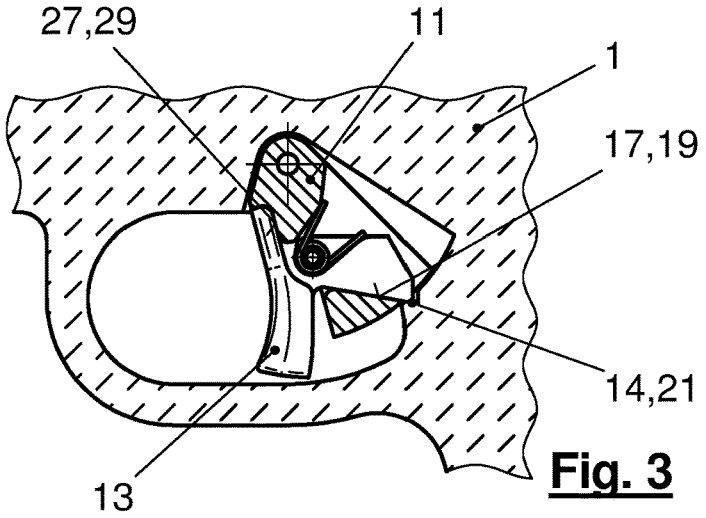
FIG. 3 shows a vertical section in a first position.
Figure 4:
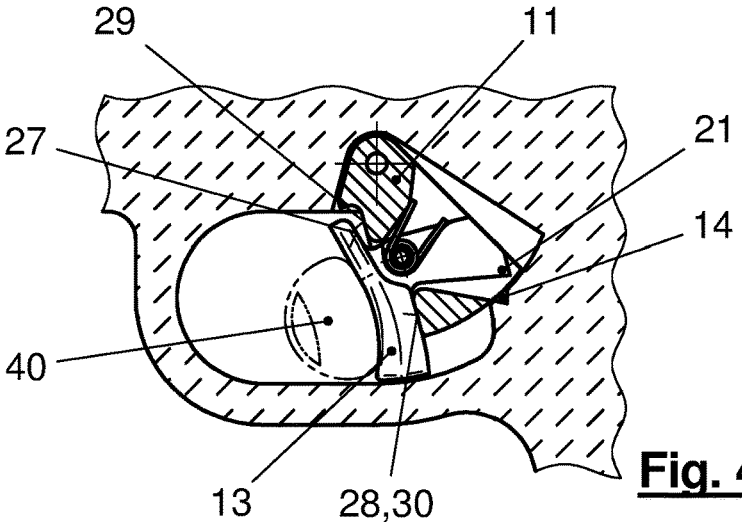
FIG. 4 shows a vertical section in a second position.
Figure 5:
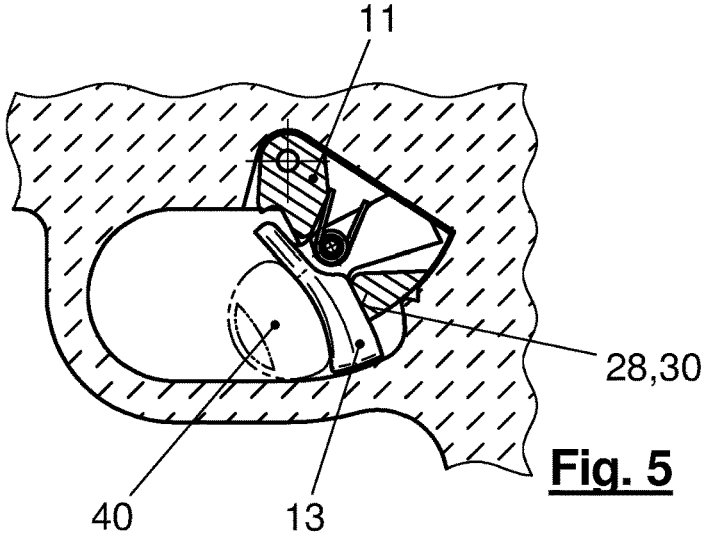
FIG. 5 shows a vertical section in a third position.
Figure 6:
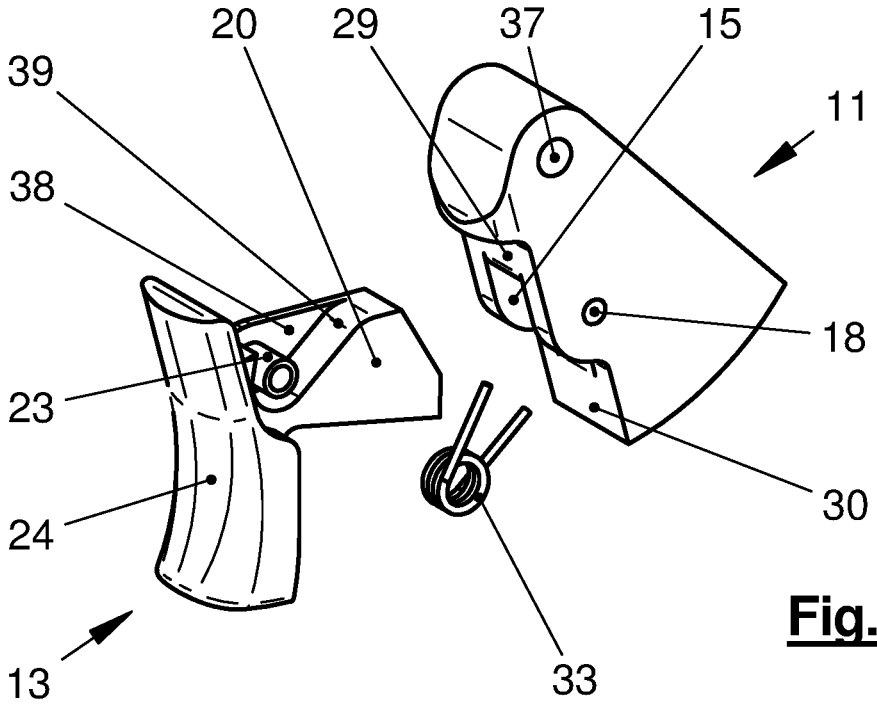
FIG. 6 shows detail A of FIG. 1, axonometric and exploded.

The functions are described with reference to FIGS. 3 to 5. The position of FIG. 3 is the rest position and is identical to FIG. 2. If the shooter puts the trigger finger 40 on the safety lever 13, the latter reaches the position of FIG. 4 against the force of the leg spring 33 (FIG. 6). In this position, the lower contact surfaces 28, 30 abut on each other and the shoulder 21 has left the catch 14, the trigger lever 11 being still in the position of FIG. 3. Only upon further movement of the trigger finger 40 the trigger lever will also be pivoted into the position of FIG. 5, and then, the shot will be triggered.

FIG. 6 shows the trigger lever 11 and the safety lever 13 in detail prior to assembly. The trigger lever 11 is a molded part whose width approximately corresponds to the width of the trigger guard 3 (FIG. 1) and whose longitudinal slot 15 has the width required for receiving the extension 20 and the eye 23. The bore 37 near the upper end receives the first pivot axle 10 (FIG. 2). The cross bore 18 receives the second pivot axle 12 (FIG. 2) and is mounted coaxially with the eye 23 of the safety lever 13.

At the transition from the finger rest 24 to the extension 20, the safety lever 13 has a recess 38 for receiving the leg spring 33, which is delimited by a surface 39, on which abuts the lower leg 35 (FIG. 2) of the leg spring 33. In the spatial representation, it can clearly be seen that, thanks to the innovation, the finger rest 24 can be designed completely free and in an ergonomically optimized manner. Shown therein concavely in the vertical direction and convexly in the horizontal cross-section.

The invention claimed is:

1. A pistol with a safety trigger, comprising:

a trigger lever supported in a housing and arranged in a trigger region formed between the housing and a trigger guard; and a safety lever being pivotally mounted therein, wherein the safety lever interacts with a catch in the housing, and wherein the safety lever is arranged in front of the trigger lever, extends over a height between the housing and the trigger guard in the trigger region and is mounted on the trigger lever, the safety lever including a first upper contact surface and a first lower contact surface on a rear side of the safety lever facing said trigger lever, and the trigger lever comprising a corresponding second upper contact surface and a second lower contact surface, wherein, in the blocking position, the upper contact surfaces of the safety lever and the trigger lever abut each other and, in the released position, the lower contact surfaces of the safety lever and the trigger lever abut each other.

2. The pistol according to claim 1, further comprising an extension formed on the safety lever that passes through a longitudinal slot of the trigger lever, the extension having an eye for the pivot axle, and on a rear end, has a shoulder for interacting with the catch in the housing, the pivot axle being supported on both sides in the trigger lever and the eye accommodating at least one winding of a leg spring.

3. The pistol according to claim 2, wherein the leg spring is supported by a leg on the upper edge of the longitudinal slot and with the other leg on the extension.

4. The pistol according to claim 2, wherein the lower edge of the extension abuts the lower edge of the longitudinal slot, in the blocking position.

5. The pistol according to claim 1, wherein the front side of the safety lever forms a finger support, which is concavely curved over an entire height of the safety lever in a side view and is convex in a horizontal cross-section.

* * * * *